US007470224B1

(12) United States Patent
Everett

(10) Patent No.: US 7,470,224 B1
(45) Date of Patent: Dec. 30, 2008

(54) COMBINED RESISTANCE/MAGNETIC EXERCISE APPARATUS

(76) Inventor: Roy J. Everett, 809 Harvest Brook Dr., Lawrenceville, GA (US) 30043

( * ) Notice: Subject to any disclaimer, the term of this patent is extended or adjusted under 35 U.S.C. 154(b) by 0 days.

(21) Appl. No.: 11/735,973

(22) Filed: Apr. 16, 2007

(51) Int. Cl.
*A63B 21/02* (2006.01)
*A63B 23/00* (2006.01)

(52) U.S. Cl. ..... 482/121; 482/148

(58) Field of Classification Search ..... 482/4, 482/5, 98, 100, 121–123, 126, 129–130, 482/137, 148
See application file for complete search history.

(56) References Cited

U.S. PATENT DOCUMENTS

| | | | | | |
|---|---|---|---|---|---|
| 1,324,404 | A * | 12/1919 | Metzger | 482/127 |
| 4,625,963 | A * | 12/1986 | Lancellotti | 482/130 |
| 4,643,420 | A * | 2/1987 | Riley et al. | 482/130 |
| 4,856,775 | A * | 8/1989 | Colledge et al. | 482/148 |
| 5,013,035 | A | 5/1991 | Nathaniel | |
| 5,096,188 | A * | 3/1992 | Shen | 482/51 |
| 5,178,591 | A * | 1/1993 | Lyons | 482/52 |
| 5,488,755 | A * | 2/1996 | Chang | 16/430 |
| 5,830,107 | A * | 11/1998 | Brigliadoro | 482/1 |
| 5,997,448 | A | 12/1999 | Duba | |
| 6,217,483 | B1 * | 4/2001 | Kallassy | 482/38 |
| 6,248,047 | B1 * | 6/2001 | Abdo | 482/130 |
| 6,290,630 | B1 * | 9/2001 | Boland | 482/130 |
| 6,616,580 | B1 * | 9/2003 | Chen | 482/123 |
| 7,013,588 | B2 * | 3/2006 | Chang | 36/141 |
| 7,137,937 | B2 * | 11/2006 | Croft | 482/142 |
| 7,147,579 | B2 * | 12/2006 | Forrest | 473/441 |
| 2004/0110610 | A1 * | 6/2004 | Chen et al. | 482/123 |
| 2005/0130814 | A1 | 6/2005 | Nitta et al. | |
| 2005/0266969 | A1 * | 12/2005 | Karafa | 482/126 |
| 2006/0128540 | A1 * | 6/2006 | Engle | 482/123 |
| 2006/0240955 | A1 * | 10/2006 | Pu | 482/79 |
| 2007/0225124 | A1 * | 9/2007 | Cabados | 482/23 |

* cited by examiner

*Primary Examiner*—Fenn C. Mathew
*Assistant Examiner*—Andrew M Tecco
(74) *Attorney, Agent, or Firm*—Crossley Patent Law; Mark A. Crossley

(57) ABSTRACT

A combined resistance/magnetic exercise apparatus which uses both adjustable resistance and magnetic forces to improve mind and body in a variety of chosen exercises. Magnets are provided in the handle grips of the cross bar an in the platform upon which a user stands. The portable apparatus provides a curved upward extension to which the cross bar is mounted, via a flex joint. A plurality of eyelets and loops are also provided for use with included elastic cables with handles.

12 Claims, 4 Drawing Sheets

COMBINED RESISTANCE/MAGNETIC EXERCISE APPARATUS

BACKGROUND OF THE INVENTION

Sophisticated resistance exercise enthusiasts have come to realize that many factors influence relative success of exercise devices. Standing or seated exercise, angles of leverage, means of applying leverage, electrical, environmental, magnetic influence—all can play a significant role in the effectiveness of exercise on both mind and body. Mind and body, in fact, cannot be separated in exercise. Chi energy is a term used by many to define potential benefit of exercise. Chi energy can result from properly applied exercise using external factors other than simply resistance. Chi energy is a positive mind/body force. Magnets, for example, influence chi energy. Just one pathway of magnetic influence is a result of magnetic interaction of the iron of hemoglobin in blood. The present apparatus provides portable, compact, standing abdominal resistance, and well as resistance to other exercise movements, while at the same time providing magnetic influence on a user through magnetic forces in both the platform and the handles of the apparatus, thereby resulting in a positive mind/body influence.

FIELD OF THE INVENTION

The combined resistance/magnetic exercise apparatus relates to exercise devices and more especially to compact, basic exercise apparatus which uses both magnetic energy flow and resistance in improving a user's mind and body.

DESCRIPTION OF THE PRIOR ART

Elastic resistance exercise devices are prevalent in prior art. However, elastic resistance certainly does not include design and function similarity in the art, as each device typically applies resistance in different directions through differing leverage positions. Devices also differ in size, true portability, weight, and complexity. No prior art combines magnetic influence and resistance exercise in the unique design of the present apparatus. For example, prior related art U.S. Pat. No. 5,013,035 issued to Nathaniel 1991-05-07 teaches an exercise device with a pair of spaced parallel base member adapted for support on a floor. The device further comprises spaced apart parallel vertical posts extending upwardly. The device thereby differs from the present single upwardly curved extension and magnetic platform of the present apparatus. Exercise resistance and directional leverage also differs. The device is also not as compact as the present apparatus.

U.S. Pat. No. 5,997,448 issued to Duba 1999-12-07 teaches a physical exercising station that must be leveraged between a floor and a ceiling. The device differs from the present apparatus by requiring such leveraging and by providing no magnetically influenced exercise. The device further differs by sliding location of the handle.

U.S. Pat. Application No. 2005/0130814A1 issued to Nitta et al. 2005-06-16 teaches an exercise apparatus with reconfigurable frame, resistance system, and platform. The device cannot provide for the performance of the same exercises of the present apparatus.

While the above-described devices fulfill their respective and particular objects and requirements, they do not describe a combined resistance/magnetic exercise apparatus that provides for the advantages of the combined resistance/magnetic exercise apparatus. In this respect, the combined resistance/magnetic exercise apparatus substantially departs from the conventional concepts and designs of the prior art. Therefore, a need exists for an improved combined resistance/magnetic exercise apparatus.

SUMMARY OF THE INVENTION

The general purpose of the combined resistance/magnetic exercise apparatus, described subsequently in greater detail, is to provide a combined resistance/magnetic exercise apparatus which has many novel features that result in an improved combined resistance/magnetic exercise apparatus which is not anticipated, rendered obvious, suggested, or even implied by prior art, either alone or in combination thereof.

To attain this, the combined resistance/magnetic exercise apparatus comprises a platform to which a vertically curved extension is attached and braced. The extension slideably receives a top bar. The top bar is fitted with a flex joint which resists flexing. The handle with inset is fitted to the second top bar atop the flex joint. The handle inset provides for clearing a user's head, or other body parts as desired, in pull-down or push-up use of the cross bar. The cross bar and flex joint thereby provide resistance against any exercise the user may choose which involved pushing up or pulling down the cross bar.

Resistance against cross bar movement is also provided by the flexible resistance cable. The cable is held and guided along the curved extension by a plurality of cable retainers. A resistance adjustment knob disposed at each end of the resistance cable provides resistance adjustment. The cross bar is further fitted with the bar loop for attaching the rope. The rope is used is many exercises, such as but not limited to stomach curls and triceps movements. Pull downs may also be executed with the cross bar or rope, as desired.

The platform is provided with a plurality of frame loops and eyelets so that a user can perform resistance exercises with the elastic cables provided as a part of the apparatus. The elastic cables are known in many arts. The apparatus provides such accessory cables, in various lengths, with hooks for the loops and eyelets on one end and with handles on the opposing ends. With the cross bar, rope, and accessory elastic cables, virtually any imaginable resistance exercise can be performed with the apparatus. The components used in manufacture of the frame and related extension, horizontal, and brace, comprise metal, alloys, and plastics, so that light weight are portability are enabled.

The magnets disposed in the platform and optionally in bar grips provide further benefit to the user. The benefits of magnetic influence in health have been documented. Further, exposing the benefits of magnetic forces with exercise provides further whole body benefits. Chi is a well-known term describing some of these benefits. Included in those benefits are the effects of magnetic forces on blood hemoglobin, for improved circulatory response to the exercise performed on the apparatus.

Thus has been broadly outlined the more important features of the improved combined resistance/magnetic exercise apparatus so that the detailed description thereof that follows may be better understood and in order that the present contribution to the art may be better appreciated.

An object of the combined resistance/magnetic exercise apparatus is to promote overall body and mind health.

Another object of the combined resistance/magnetic exercise apparatus is to promote chi in a user.

A further object of the combined resistance/magnetic exercise apparatus is to provide for a plurality of exercises.

An added object of the combined resistance/magnetic exercise apparatus is to combine the benefits of exercise movements with magnetic influence.

And, an object of the combined resistance/magnetic exercise apparatus is to provide adjustability in imposing resistance.

These together with additional objects, features and advantages of the improved combined resistance/magnetic exercise apparatus will be readily apparent to those of ordinary skill in the art upon reading the following detailed description of presently preferred, but nonetheless illustrative, embodiments of the improved combined resistance/magnetic exercise apparatus when taken in conjunction with the accompanying drawings.

In this respect, before explaining the current embodiments of the improved combined resistance/magnetic exercise apparatus in detail, it is to be understood that the combined resistance/magnetic exercise apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved combined resistance/magnetic exercise apparatus. It is therefore important that the claims be regarded as including such equivalent constructions insofar as they do not depart from the spirit and scope of the combined resistance/magnetic exercise apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 4 thereof, the principles and concepts of the combined resistance/magnetic exercise apparatus generally designated by the reference number 10 will be described.

Figure 1:
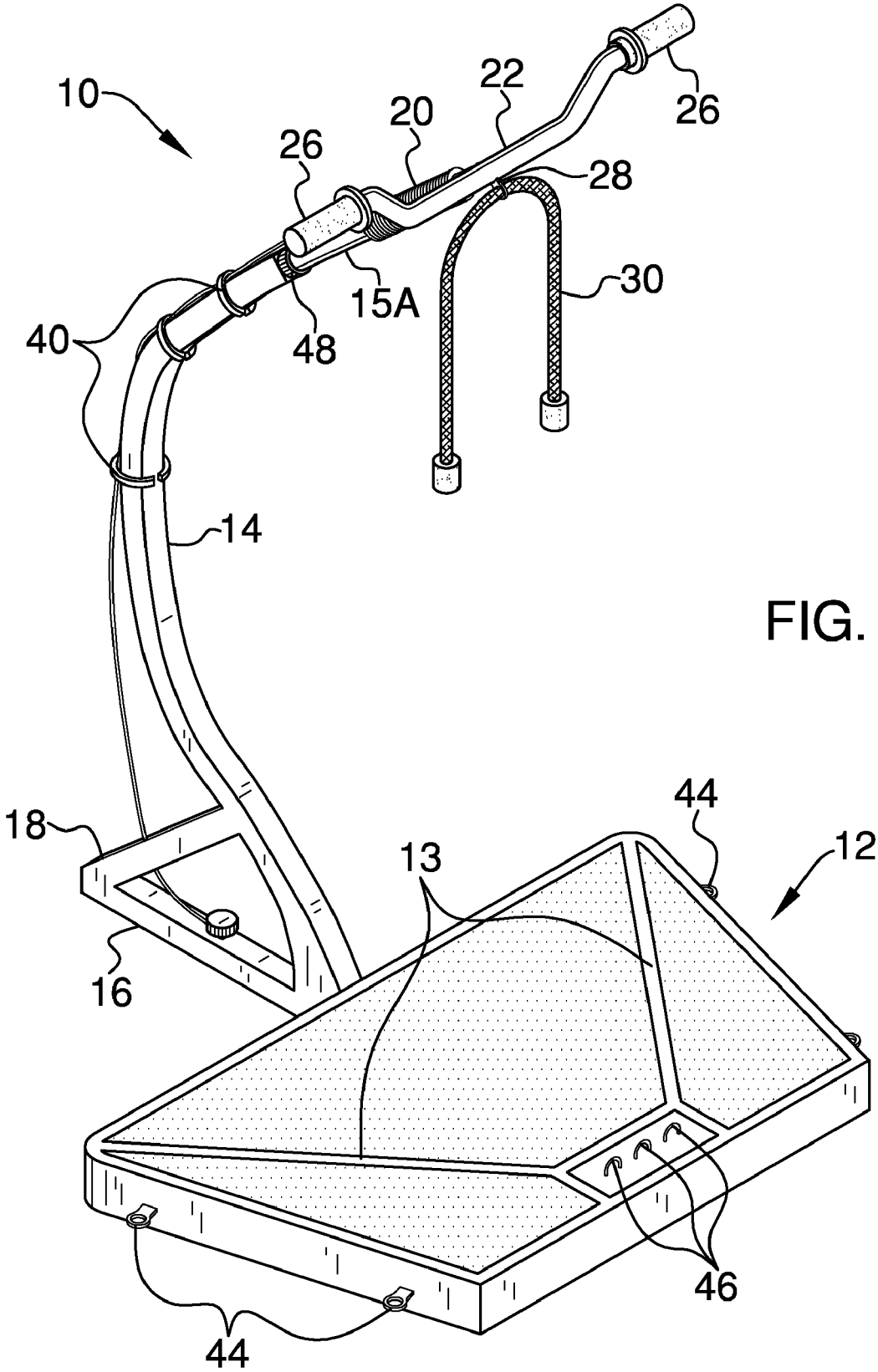
FIG. 1 is a frontal perspective view.
Figure 2:
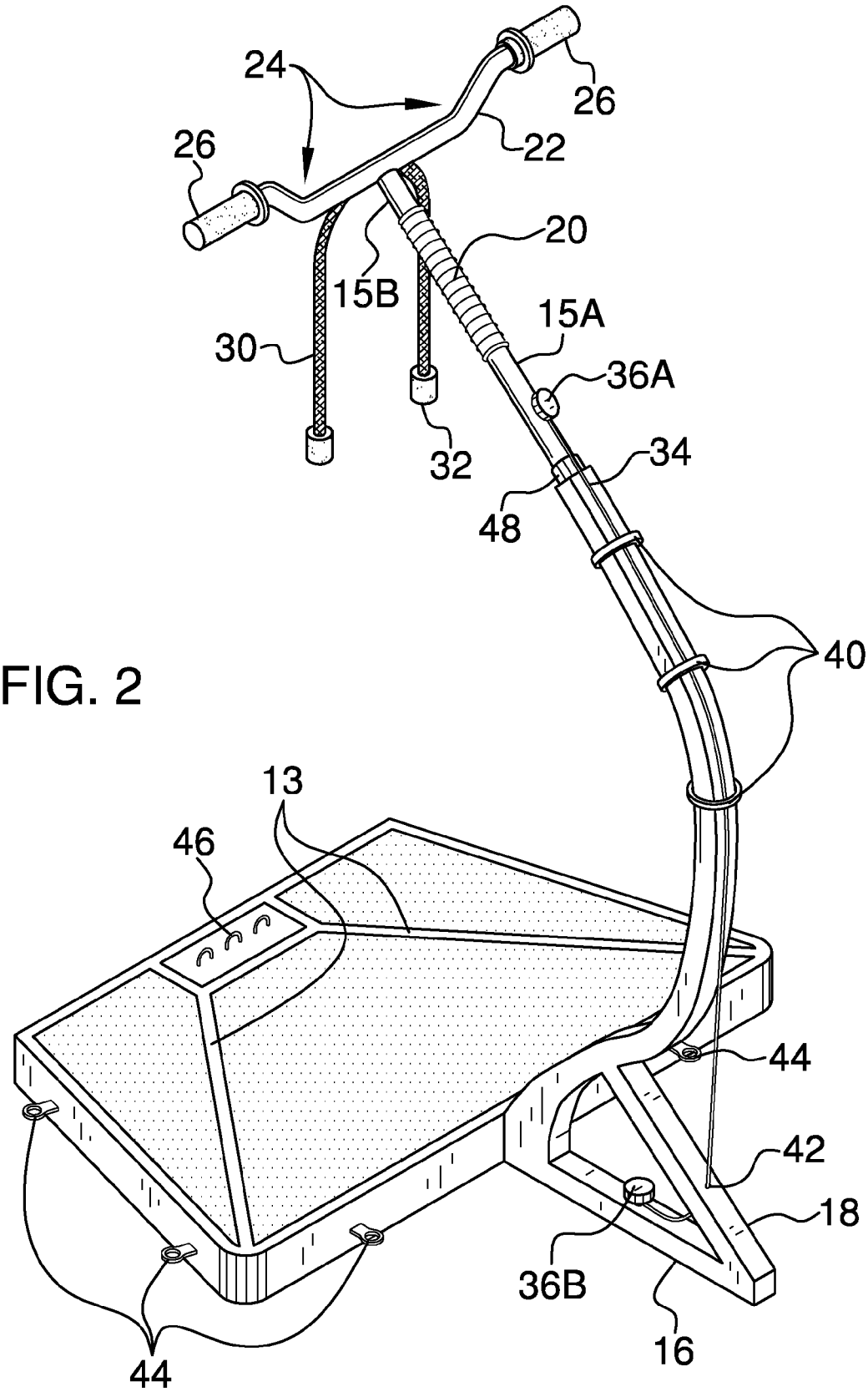
FIG. 2 is a rear perspective view.
Figure 3:
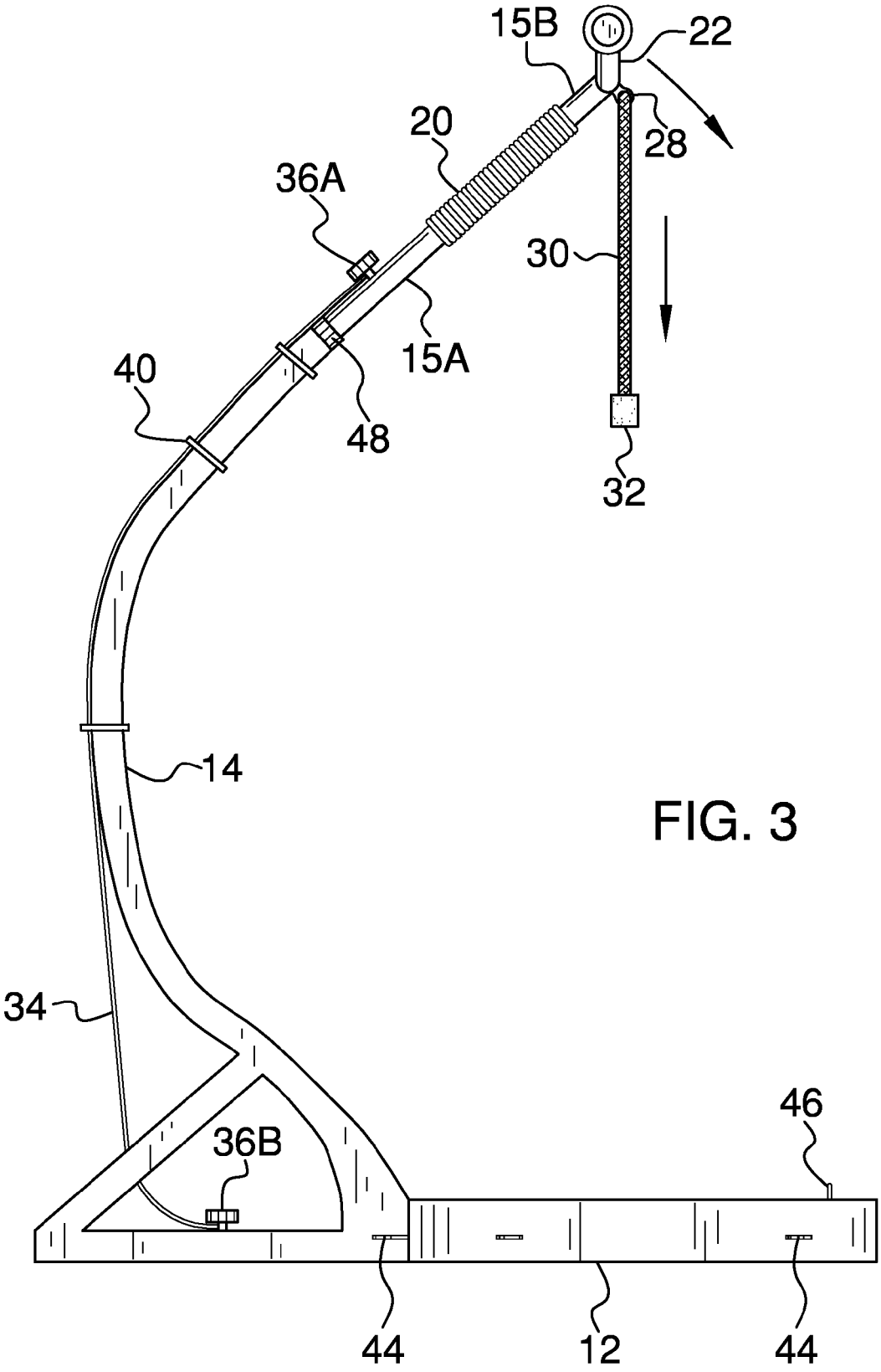
FIG. 3 is side elevation view.

Referring to FIGS. 1 through 3, the exercise apparatus 10 combines resistance and magnetic forces. The apparatus 10 comprises a trapezoidal platform 12 having a border and an interior. The plurality of braces 13 is disposed within the interior of the platform 12. The braces 13 provide for strength of the relatively light-weight platform 12, thereby negating the need for solid, heavier construction. The plurality of eyelets 44 is disposed around the outside of the platform 12 border. The plurality of frame loops 46 is extended from the top surface of the platform 12. The frame loops 46 are disposed proximal to the front side of the platform 12. The frame loops 46 and the eyelets 44 provide for attachment of elastic cables with handles (not shown) which are also a part of the apparatus. Bungee™ cords and the like are available as elastic cables.

The curved vertical extension 14 emanates from the back side of the platform 12. The horizontal 16 is extended from the junction of the extension 14 and the platform 12. The angled extension brace 18 connects the rear of the horizontal 16 to the curved extension 14. The first top bar 15A is slideably inserted into the top of the curved extension 14. The crimp clamp 48 is for selectively locating the first top bar 15A within the curved extension 14. Loosening the crimp clamp 48 provides for sliding the first top bar 15A as desired within the curved extension 14. Tightening the crimp clamp 48 firmly positions the first top bar 15A. The flex joint 20 has a first end and a second end. The first end of the flex joint 20 is affixed to the top of the first top bar 15A. The second top bar 15B is affixed to the second end of the flex joint 20. The cross bar 22 has opposed spaced apart ends and a center. The center of the cross bar 22 is affixed to the second top bar 15B. The bar inset 24 comprises the majority of the cross bar 22 length. A bar grip 26 is disposed on each end of the cross bar 22. The bar grips 26 are optionally magnetic. The bar loop 28 is affixed to the center of the cross bar 22. The rope 30 is removably fitted to the bar loop 28. A rope grip 32 is disposed on each end of the rope 30. The resistance adjustment knob 36A is disposed on the first top bar 15A. The resistance adjustment knob 36B is disposed on the horizontal 16. The orifice 42 is disposed in the extension brace 18. The flexible resistance cable 34 is affixed to each resistance adjustment knob 36A and 36B. The cable 34 is passed through the brace orifice 42. The plurality of cable retainers 40 is disposed on the curved extension 14. The adjustment knobs 36A and 36B are used to tension the flexible resistance cable 34 as desired.

Figure 4:
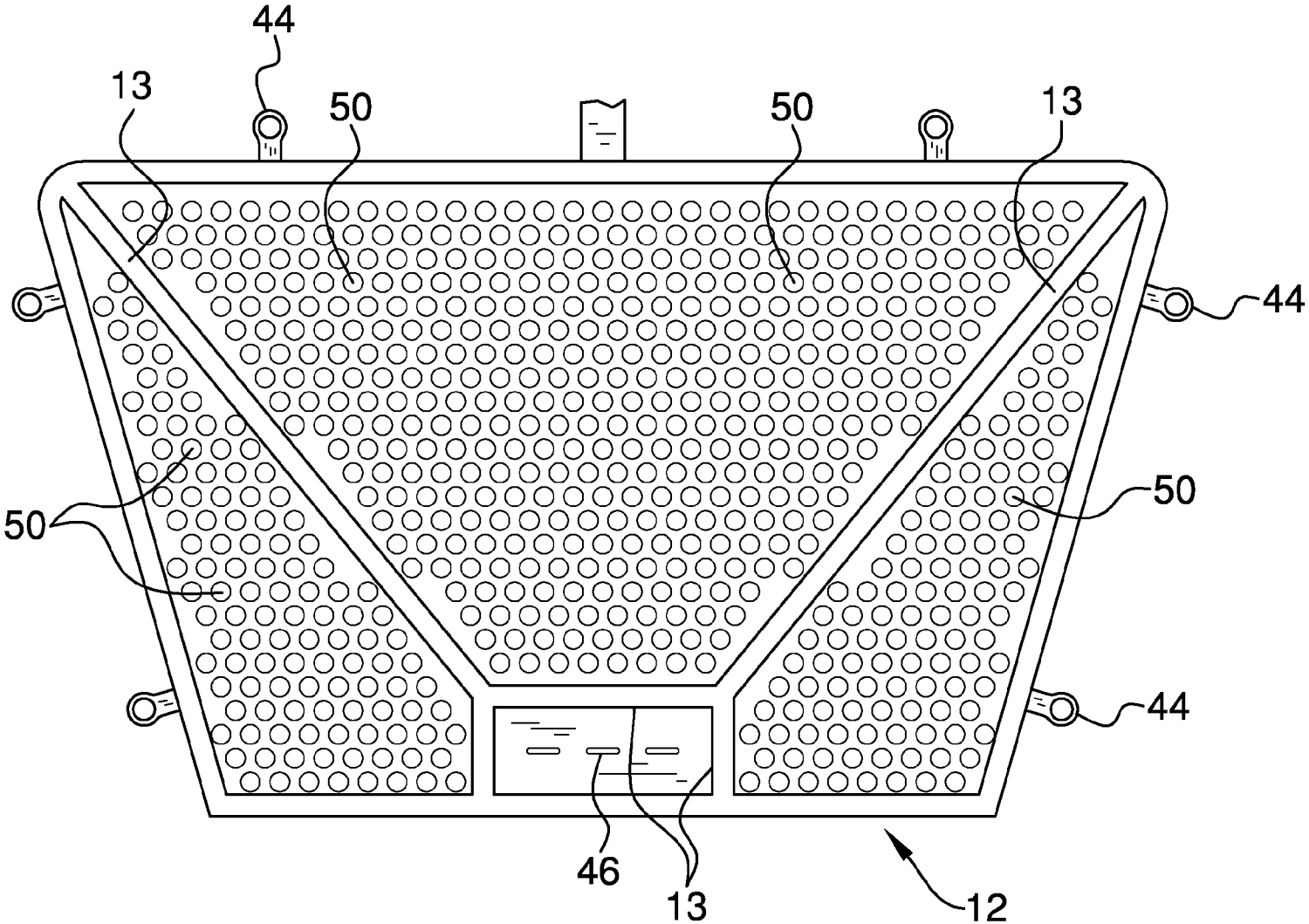
FIG. 4 is top plan view of the platform.

Referring to FIG. 4, the plurality of magnets 50 is disposed within the platform 12. The magnets 50 are adjacent to the top surface of the platform 12. The magnets 50 may optionally be covered with a thin protective layer (not shown). The magnets 50, in an additional embodiment, may be on the surface of the platform 12, with no protective layer.

With respect to the above description then, it is to be realized that the optimum dimensional relationships for the parts of the combined resistance/magnetic exercise apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the combined resistance/magnetic exercise apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the combined resistance/magnetic exercise apparatus may be used.

Therefore, the foregoing is considered as illustrative only of the principles of the combined resistance/magnetic exercise apparatus. Further, since numerous modifications and changes will readily occur to those skilled in the art, it is not desired to limit the combined resistance/magnetic exercise apparatus to the exact construction and operation shown and described, and accordingly, all suitable modifications and equivalents may be resorted to, falling within the scope of the combined resistance/magnetic exercise apparatus.

What is claimed is:

1. An exercise apparatus combining resistance and magnetic forces, the apparatus comprising:

a trapezoidal platform having a border and an interior;

a plurality of braces disposed within the interior of the platform;

a plurality of magnets disposed within the platform, the magnets adjacent to a top surface of the platform;

a curved vertical extension emanating from a back side of the platform;

a horizontal extended from a junction of the extension and the platform;

an angled extension brace connecting a rear of the horizontal to the curved extension;

a first top bar slideably inserted into a top of the curved extension;

a crimp clamp for selectively locating the first top bar within the curved extension;

a flex joint, the flex joint having a first end and a second end, the first end affixed to a top of the first top bar;

a second top bar affixed to the second end of the flex joint;

a cross bar having opposed spaced apart ends and a center, the center of the cross bar affixed to the second top bar; and a bar grip on each end of the cross bar, wherein each grip is magnetic.

2. The apparatus according to claim 1 further comprising a bar loop affixed to the center of the cross bar;

a rope removably fitted to the bar loop;

a rope grip on an each end of the rope.

3. An exercise apparatus combining resistance and magnetic forces, the apparatus comprising:

a trapezoidal platform having a border and an interior;

a plurality of braces disposed within the interior of the platform;

a plurality of magnets disposed within the platform, the magnets adjacent to a top surface of the platform;

a plurality of eyelets disposed around an outside of the platform border;

a plurality of frame loops extended from the top surface of the platform, the frame loops proximal to a front side of the platform;

a curved vertical extension emanating from a back side of the platform;

a horizontal extended from a junction of the extension and the platform;

an angled extension brace connecting a rear of the horizontal to the curved extension;

a first top bar slideably inserted into a top of the curved extension;

a crimp clamp for selectively locating the first top bar within the curved extension;

a flex joint, the flex joint having a first end and a second end, the first end affixed to a top of the first top bar;

a second top bar affixed to the second end of the flex joint;

a cross bar having opposed spaced apart ends and a center, the center of the cross bar affixed to the second top bar;

a bar grip on each end of the cross bar.

4. The apparatus according to claim 3 further comprising a bar inset in the cross bar.

5. The apparatus according to claim 3 further comprising magnetic bar grips.

6. The apparatus according to claim 4 further comprising magnetic bar grips.

7. The apparatus according to claim 3 further comprising a bar loop affixed to the center of the cross bar;

a rope removably fitted to the bar loop;

a rope grip on an each end of the rope.

8. The apparatus according to claim 4 further comprising a bar loop affixed to the center of the cross bar;

a rope removably fitted to the bar loop;

a rope grip on an each end of the rope.

9. The apparatus according to claim 5 further comprising a bar loop affixed to the center of the cross bar;

a rope removably fitted to the bar loop;

a rope grip on an each end of the rope.

10. The apparatus according to claim 6 further comprising a bar loop affixed to the center of the cross bar;

a rope removably fitted to the bar loop;

a rope grip on an each end of the rope.

11. An exercise apparatus combining resistance and magnetic forces, the apparatus comprising:

a trapezoidal platform having a border and an interior;

a plurality of braces disposed within the interior of the platform;

a plurality of magnets disposed within the platform, the magnets adjacent to a top surface of the platform;

a plurality of eyelets disposed around an outside of the platform border;

a plurality of frame loops extended from the top surface of the platform, the frame loops proximal to a front side of the platform;

a curved vertical extension emanating from a back side of the platform;

a horizontal extended from a junction of the extension and the platform;

an angled extension brace connecting a rear of the horizontal to the curved extension;

a first top bar slideably inserted into a top of the curved extension;

a crimp clamp for selectively locating the first top bar within the curved extension;

a flex joint, the flex joint having a first end and a second end, the first end affixed to a top of the first top bar;

a second top bar affixed to the second end of the flex joint;

a cross bar having opposed spaced apart ends and a center, the center of the cross bar affixed to the second top bar;

a bar inset in the cross bar;

a bar grip on each end of the cross bar;

a bar loop affixed to the center of the cross bar;

a rope removably fitted to the bar loop;

a rope grip on an each end of the rope;

a resistance adjustment knob disposed on the first top bar;

a resistance adjustment knob disposed on the horizontal;

an orifice in the extension brace;

a flexible resistance cable affixed to each resistance adjustment knob, the cable passed through the brace orifice;

a plurality of cable retainers disposed on the curved extension.

12. The apparatus according to claim 11 further comprising magnetic bar grips.

* * * * *